US009415284B1

(12) United States Patent
Williamson

(10) Patent No.: US 9,415,284 B1
(45) Date of Patent: Aug. 16, 2016

(54) SHATTER-RESISTANT BAT

(71) Applicant: J. Kent Williamson, Girard, PA (US)

(72) Inventor: J. Kent Williamson, Girard, PA (US)

( * ) Notice: Subject to any disclaimer, the term of this patent is extended or adjusted under 35 U.S.C. 154(b) by 0 days.

(21) Appl. No.: 14/832,753

(22) Filed: Aug. 21, 2015

(51) Int. Cl.

| | |
|---|---|
| ***A63B 59/00*** | (2015.01) |
| ***A63B 59/06*** | (2006.01) |
| ***B27C 7/00*** | (2006.01) |
| ***B27M 1/08*** | (2006.01) |
| ***B27M 1/02*** | (2006.01) |
| ***B27M 3/22*** | (2006.01) |

(52) U.S. Cl.
CPC ..... *A63B 59/06* (2013.01); *A63B 59/0029* (2013.01); *B27C 7/00* (2013.01); *B27M 1/02* (2013.01); *B27M 1/08* (2013.01); *B27M 3/22* (2013.01); *A63B 59/50* (2015.10); *A63B 60/06* (2015.10)

(58) Field of Classification Search
CPC ..... A63B 2102/18; A63B 2102/182; A63B 59/50–59/58; A63B 2059/581
USPC ..... 473/457, 519, 520, 564–568
See application file for complete search history.

(56) References Cited

U.S. PATENT DOCUMENTS

| | | | | | |
|---|---|---|---|---|---|
| 310,248 | A * | 1/1885 | Brown | A63B 59/50 | 473/564 |
| 780,244 | A | 1/1905 | Trusdell | | |
| 2,101,714 | A * | 12/1937 | Keeney | A63B 60/10 | 427/230 |
| 3,598,410 | A * | 8/1971 | Costopoulos | A63D 9/00 | 156/172 |
| 5,042,805 | A * | 8/1991 | Nakai | A01K 87/08 | 114/90 |
| 6,139,451 | A * | 10/2000 | Hillerich, III | B29C 61/006 | 473/564 |
| 6,238,309 | B1 * | 5/2001 | Sample | A63B 59/50 | 473/564 |
| 7,448,971 | B1 | 11/2008 | Smalley | | |
| 8,113,972 | B2 | 2/2012 | Dobransky | | |
| 8,591,357 | B1 | 11/2013 | Bonds et al. | | |
| 2009/0325738 | A1 * | 12/2009 | Pryor | A63B 59/50 | 473/568 |
| 2013/0045823 | A1 * | 2/2013 | Sublett, Sr. | A63B 59/50 | 473/564 |

* cited by examiner

*Primary Examiner* — Mark Graham
(74) *Attorney, Agent, or Firm* — Richard K. Thomson

(57) ABSTRACT

The handle portion (the initial 18") of the bat is formed with a spiral groove with succeeding revolutions spaced by a distance in the range of between ¼" and ½". A 30 lb test fishing line is secured in the groove by adhesive and the handle is coated with an non-drip epoxy which is then over coated with elastomer which is preferably shavings from recycled tires. The finished handle is created by sanding the elastomer to form a smooth grip which is contiguous with the initial end of the bat's barrel.

3 Claims, 1 Drawing Sheet

SHATTER-RESISTANT BAT

BACKGROUND AND SUMMARY OF THE INVENTION

News reports of persons being seriously injured by shrapnel from an exploding baseball bat are becoming all too common. It is a primary object of the present invention to provide bats in which handles resist becoming disassociated with major portions of the barrel of a bat and thereby reduce the risk to both players and fans who have the singular misfortune of being in the wrong place at the wrong time.

A number of efforts have been made to address this problem. In fact, the Truesdell patent U.S. Pat. No. 780,244 issued Jan. 17, 1905 indicates the problem has been known for over a century. Most, if not all of these proposed "solutions" involve removal of material from either the interior or exterior of the bat's surface, perforce weakening the bat structure. Removing wood from the bat virtually ensures that it will fail; hence, these proposed solutions amplify, while attempting to control, the problem of bats shattering into multiple pieces. Any attempt to fix this problem at the Major League Baseball (MLB) level must past muster with the MLB rules and regulations. Rule 1.10 specifies "(c) The bat handle, for not more than 18 inches from its end, may be covered or treated with any material or substance to improve the grip." The problem has been "remedied" at the little league level by converting to aluminum bats. However, metal bats are, in themselves, a dangerous weapon and there is a movement afoot to revert to wooden bats; solving the bat shattering problem will make this restoration of wooden bats at the little league level even more attractive.

The bat of the present invention wraps the 18" handle portion with a nylon cord (i.e., fishing line) in a spiral configuration. The cord is preferably adhered into a groove, which is preferably formed by compressing the wood, rather than removing material, thereby strengthening the wood rather than weakening it. The respective revolutions of the spiral are spaced by a distance falling in the range between ¼" and ½". The reinforced bat handle is then dipped in a viscous, non-dripping epoxy and coated with recycled rubber chips. It is preferred that the rubber chips be formed from recycled, discarded auto and truck tires. Finally, the handle is sanded to form a smooth grippable surface which is contiguous with the barrel of the bat.

Various other features, advantages, and characteristics of the present invention will become apparent after a reading of the following detailed description.

BRIEF DESCRIPTION OF THE DRAWINGS

The preferred embodiment(s) of the present invention is/are described in conjunction with the associated drawings in which like features are indicated with like reference numerals and in which.

DETAILED DESCRIPTION OF THE PREFERRED EMBODIMENT(S)

Figure 1:
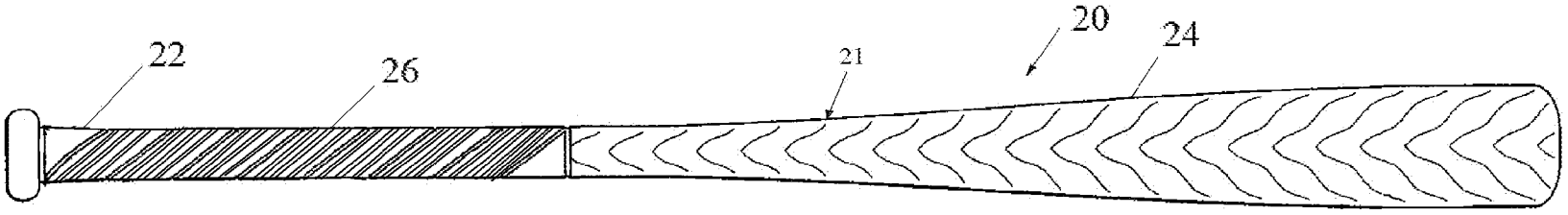
FIG. 1 is a side view of a treated bat blank with the spiral pattern formed on the handle; and, FIG. 2 is a side view of a completed bat of the present invention.
Figure 2:
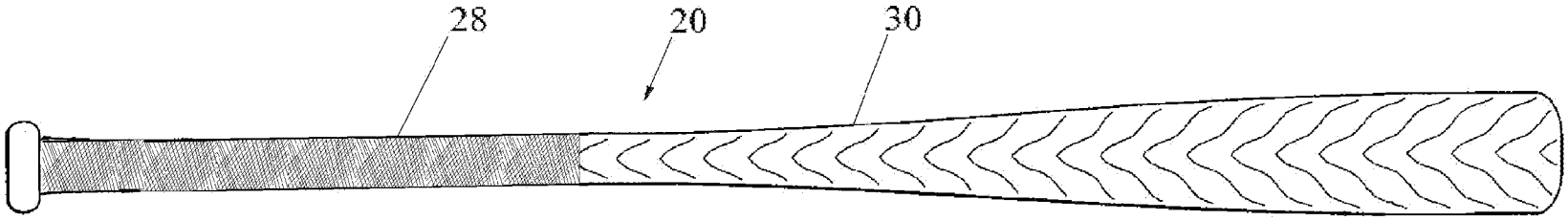

A first embodiment of the of the present invention is depicted in FIGS. 1-2 generally at 20. The method of making the bat 20 of the present invention involves selecting a block of wood selected from the group consisting of maple, northern white ash, and birch. The block is then turned on a lathe, or formed into a rounded stick in some other manner to produce a bat blank no longer than 42" in length and having a first reduced diameter portion 22 and a second enlarged diameter portion 24, in which the larger diameter portion is no greater than 2.61". These size restrictions apply to bats utilized in Major League Baseball. Dimensions for Little League, college, high school and elementary school baseball will vary. Once the initial blank 21 is formed, a spiral groove 26 is formed around the forward 18" of the bat, the portion that MLB identifies as the handle portion 22. This spiral groove is preferably formed by compressing the wood, rather than notching through removal as less material necessarily involves weakening of the bat structure. The revolutions of spiral groove 26 are preferably spaced by a distance falling in the range of between ¼" and ½" to a depth of 1/32" which accommodates a 13.6 kg (30 lb test) nylon fishing line with a diameter of 0.33 mm.

Subsequently, the handle is coated with a non-drip epoxy. Prior to forming this first coating on the handle, a light coating of the epoxy may be brushed into the grooves to adhere the fishing line therein. Suitable epoxies include 3M bonding adhesive auto mix epoxy and Shell's 2-to-1 epoxy. While the first epoxy coating is wet, a second coating of elastomeric material is adhered to handle portion 22. Preferably, this elastomeric coating is formed of fine shavings of recycled auto and truck tires which then, become adhered to the handle. Once the epoxy dries, the rubber elastomer coating is smoothed by sanding the surface to form a grip that is contiguous (even with) the initial end of the barrel 24.

The fishing line engaged in spiral groove 26 will prevent a barrel 24 from "flying off the handle" 22 and becoming airborne shrapnel which can endanger players and fans, alike. In addition, the rubber elastomer coating 28 provides a suitable grip that will reduce the occurrences of bats slipping out of the batter's hands and becoming a dangerous projectile in the form of a complete, air-borne war club.

Simply as an educational side note, most problems with shattering bats result from the player holding it improperly. If balls are hit with the grain rather than across the grain, they will more than likely, endure the impact. By orienting the label of the bat so that it faces the batter, the grain of the wood will be in a proper orientation allowing the bat to be used most effectively.

Various changes, alternatives, and modifications will become apparent to a person of ordinary skill in the art after a reading of the foregoing specification. It is intended that all such changes, alternatives, and modifications as fall within the scope of the appended claims be considered part of the present invention.

I claim:

1. A baseball bat comprising:

a smooth round stick having a smaller diameter end and a larger diameter end which does not exceed 2.61" in diameter at its widest part with an overall length not exceeding 42", said round stick having a) a barrel portion;

b) a handle portion having a length not exceeding a first 18" of said smaller diameter end, said handle portion including i) a spiral groove formed over a significant portion of said handle length with a spacing of revolutions falling in a range of between ¼" and ½", said spiral groove having been impressed in said handle length without removal of material;

i) a nylon cord lying in a bottom portion of said spiral groove;

iii) a first coating of viscous, non-drip epoxy over said length of said handle;

iv) a second coating of rubber placed atop said first coating, said second coating forming a contiguous surface with said barrel portion.

2. A method of making a baseball bat, said method comprising the steps of a) selecting a block of wood from a group consisting of maple, northern white ash, and birch;

b) turning said block on a lathe to form a round stick having a smaller diameter end and a larger diameter end, said larger diameter end having a dimension which does not exceed 2.61" and said stick having an overall length which does not exceed 42";

c) impressing on an initial 18" handle portion a spiral groove with spaced revolutions in a range of between ¼" and ½";

d) securing in said spiral groove a nylon reinforcing cord;

e) coating said initial 18" handle portion with a first coating of viscous non-drip epoxy;

f) over coating said first coating with a second coating of elastomer derived from shavings from recycled tires;

g) sanding said second coating to provide a smooth grip contiguous with an adjacent barrel portion.

3. The method of claim 2 wherein said impressing step is performed by compressing respective wood portions to form said spiral groove in said handle portion.

* * * * *